United States Patent [19]

Purcell et al.

[11] Patent Number: 5,035,180

[45] Date of Patent: Jul. 30, 1991

[54] SHEARING TYPE ORDNANCE VENTING DEVICE

[75] Inventors: Nick L. Purcell; Joseph A. Schmidt; John A. O'Malley, all of Ridgecrest, Calif.

[73] Assignee: The United States of America as represented by the Secretary of the Navy, Washington, D.C.

[21] Appl. No.: 594,142

[22] Filed: Mar. 28, 1984

[51] Int. Cl.[5] ..... F42B 39/00

[52] U.S. Cl. ..... 102/481; 60/253; 102/293; 102/374; 220/89.1; 220/DIG. 27

[58] Field of Search ..... 60/223, 253, 254; 220/89 B, 89 A, 367, DIG. 27, 89.1, 89.4; 236/92 C; 102/374, 293, 481; 89/1 B, 1, 14; 86/1 A, 50

[56] References Cited

U.S. PATENT DOCUMENTS

| | | | |
|---|---|---|---|
| 2,293,366 | 8/1942 | Solosko | 220/89 B |
| 2,529,644 | 11/1950 | Webber | 220/24.5 |
| 3,173,364 | 3/1965 | Nordzell | 102/1 |
| 3,448,653 | 6/1969 | Myers | 102/293 |
| 3,665,857 | 5/1972 | Radnich et al. | 102/1 R |
| 3,887,991 | 6/1975 | Panella | 220/89 B |
| 4,022,130 | 5/1977 | Johnson et al. | 102/56 R |
| 4,143,670 | 3/1979 | Olson et al. | 137/72 |
| 4,226,225 | 10/1980 | Niedermeyer | 126/422 |

*Primary Examiner*—Harold J. Tudor
*Attorney, Agent, or Firm*—Melvin J. Sliwka; Sol Shienbein

[57] ABSTRACT

An ordnance venting system is provided to reduce the danger of explosion in ordnance items exposed to fires and includes an ordance item having a number of holes in the ordnance casing, each hole covered by a metallic patch having a different differential expansion in relation to the casing to provide shearing forces when subjected to high temperatures, and a means of attaching the patches to the casing over the holes.

10 Claims, 1 Drawing Sheet

SHEARING TYPE ORDNANCE VENTING DEVICE

BACKGROUND OF THE INVENTION

1. Field of the Invention

This invention relates to the field of venting systems. More particularly, this invention relates to ordnance venting systems for reducing the danger of explosion by an ordnance item subjected to an external fire.

2. Description of the Prior Art

Catastrophic fires have occurred aboard naval ships and resulted in substantial loss of life and material. Suppression of these fires have been hindered by the explosive behavior of ordnance items in the vicinity of the fires. Efforts have been made to modify ordnance items in missile systems to preclude explosion behavior or to extend the time prior to a violent reaction to a fire.

Previous venting devices have included vent plugs, welded in the side of a motor case. These plugs would activate when heated through the use of a bimetallic spring and rotate the plug to a release position. By the release of the plug, the propellant could be exposed and vented to the external fire. Unfortunately, many such prior have proven to be too costly and have adversely affected the performance or range of certain missiles.

SUMMARY OF THE INVENTION

The present invention provides a venting system to reduce the danger of explosion from an ordnance item or other potentially explosive container subjected to a fire. The ordnance venting system comprises: a casing having a plurality of holes in the casing; a metallic patch, adjacent said casing, covering each of said plurality of holes; and means for attaching each patch to the casing.

OBJECTS OF THE INVENTION

It is an object of the present invention to provide a venting system capable of reducing the likelihood of explosion in an ordnance item subjected to an external fire.

This and other objects, features and advantages of the invention will become apparent from the following detailed description.

DETAILED DESCRIPTION OF THE PREFERRED EMBODIMENT

Figure 1:
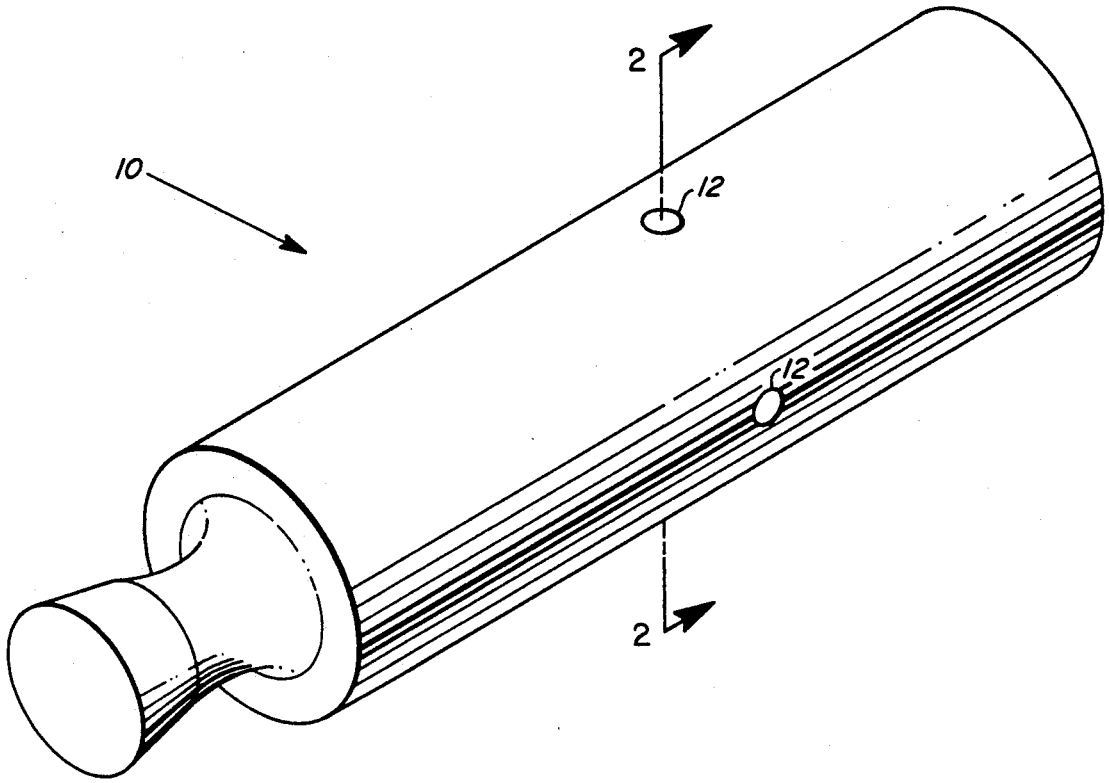
FIG. 1 is a view of a rocket motor, viewed from the nozzle end, provided with the metallic patch venting system.

Referring to FIG. 1, a rocket motor is shown which utilizes the venting system of the present invention. A motor casing 10 has metallic patches 12 affixed to the outer surface.

Figure 2:
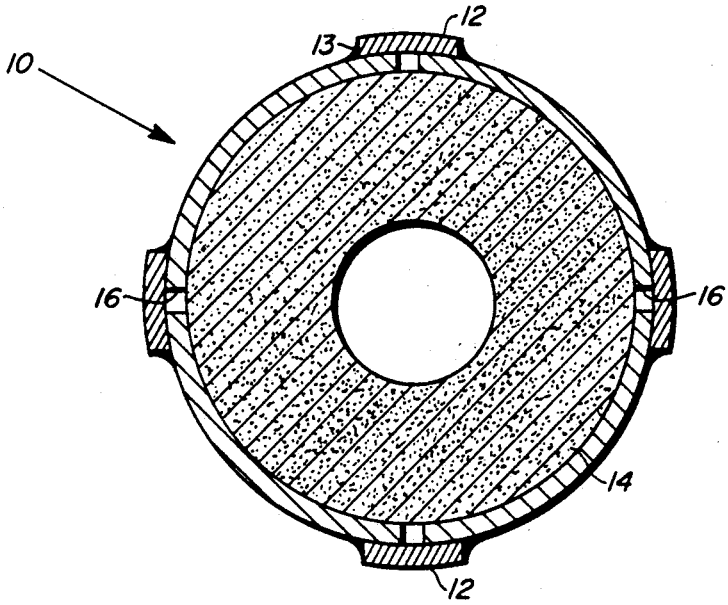
FIG. 2 is a cross-sectional view of the rocket motor along the line 2—2 of FIG. 1.

In FIG. 2, holes 16 are shown in the casing 10. The metallic patches 12 cover the holes. The principle of operation of the ordnance venting system is differential expansion between the external metallic patches 12 and the casing material. When the patches are removed through expansion due to heating, propellant grain 14 can be vented to the outside of casing. This prevents internal pressure build-up within the ordnance item from pyrolysis of the propellant lining.

The metal patches are attached to the casing by any suitable means. The use of a braze 13, solder, or adhesive can all be suitable methods of bonding or joining the patches to the casing. By selection of materials for the patches, a large gradient in temperature can be achieved between the patches and casing. The selection of materials is dependent upon the coefficients of expansion, thermal conductivities and densities of the materials. When the venting system is subjected to a fire, shearing forces develop at the interface between the patches and casing. The pyrolysis of propellant liner can assist in the removal of a patch as the internal pressure builds to levels of around 5 psi.

In utilizing differential expansion between the patches and the case, the case can be designed to expand either more or less rapidly than a patch. Motor casings on ordnance warheads and bombs have typically consisted of low alloy steels. With patches made of high alloy steel, differences of 30 to 40 percent lower coefficients of expansion can be achieved. Low expansion steel alloys can produce even larger differences in the coefficients of expansion. Nickel-iron alloys having a nickel content of about 36 to 42 percent and an iron content of about 58 to 64 percent are suitable examples. The alloys known as INVAR are nickel-iron alloys having the desired low expansion properties. The use of stainless steel for the patches provides a system with the patch expanding more rapidly than the casing to develop the shearing forces. The patches can alternatively consist of other metals, i.e., copper and titanium. Insulation of the portion desired to grow less rapidly can yield greater differences in expansion.

EXAMPLE

A test ordnance item consisted of a 5 inch diameter, 24 inch rocket motor having four metallic venting patches brazed over ¼ inch diameter holes drilled in the side of the casing. The motor casing was lined with a 0.05 inch thickness of L-17 liner and cast with a propellant. Each patch was 1.25 inch in diameter and 0.032 inch in thickness and was contoured to the outside radius of the rocket motor tube. The patches, of 4130 steel, were brazed on the outside of the casing concentric with a ¼ inch diameter hole. The braze material was a low temperature braze manufactured by Handy & Harmon, consisting of 5 percent silver and 95 percent cadmium and had a melting temperature of 740° F.

During the test, the ambient temperature was 83° F. An array of propane burners provided the heat source. Upon heating by the burners, the metallic patches were ejected providing a venting for the ordnance item.

Obviously, many modifications of the present invention are possible in light of the above teachings. It is to be understood, that within the scope of the appended claims the invention may be practiced other than as specifically described.

We claim:

1. An ordnance venting system to reduce the danger of explosion from an ordnance item subjected to a fire comprising:

an ordnance item having a cylindrical casing of a material having predetermined thermal expansion characteristics and a plurality of holes extending through the cylindrical walls of said casing;

a metallic patch having different thermal expansion properties than said casing material covering each of said plurality of holes; and means for attaching said patch to said cylindrical casing for ambient temperature ranges, said attaching means having a shear strength less than the shear force produced by heating said patch and casing to predetermined temperatures corresponding to external fire threats.

2. An ordnance venting system according to claim 1 wherein said metallic patch is steel.

3. An ordnance venting system according to claim 1 wherein said metallic patch is selected from the group consisting of steel, copper, titanium and low expansion nickel-iron alloys.

4. An ordnance venting system according to claim 1 wherein said means for attaching said patch comprises braze.

5. An ordnance venting system according to claim 1 wherein said means for attaching said patch comprises adhesive.

6. An ordnance venting system according to claim 2 wherein said means for attaching said patch comprises braze.

7. An ordnance venting system according to claim 3 wherein said means for attaching said patch comprises braze.

8. An ordnance venting system according to claim 3 wherein said means for attaching said patch comprises adhesive.

9. An ordnance venting system according to claim 4 wherein said braze comprises a material containing 5 percent by weight silver and 95 percent by weight cadmium whereby said material has a melting point of about 740° F.

10. In an ordnance item having generally cylindrical wall made of a material having predetermined thermal expansion characteristics and a void therein for containing pyrotechnic material, the improvement comprising:

a plurality of spaced apertures extending radially through said cylindrical wall of said ordnance communicating with said void therein;

a plurality of patches equal in number to the number of spaced apertures and contoured to conform to said cylindrical wall and made of a material having a predetermined coefficient of expansion different from said casing material; and a braze holding each of said patches over an associated hole and said braze being of a material having strength sufficient to hold said patch in sealing engagement under ordinarily encountered temperature but to shear when encountering stresses occasioned by said different thermal expansion at a predetermined temperature.

* * * * *